US008100395B2

(12) United States Patent
Afanasov et al.

(10) Patent No.: US 8,100,395 B2
(45) Date of Patent: Jan. 24, 2012

(54) ENERGY-EFFICIENT COMPACT DEVICE FOR DISPENSING AND ACCUMULATING BANKNOTES

(75) Inventors: Sergii Afanasov, smt. Bucha (UA); Volodymyr Shvarts, Kiev (UA); Mykhaylo Bazhenov, Kiev (UA); Olga Bazhenova, legal representative, Kiev (UA)

(73) Assignee: Crane Canada Co., Concord, ON (CA)

( * ) Notice: Subject to any disclaimer, the term of this patent is extended or adjusted under 35 U.S.C. 154(b) by 402 days.

(21) Appl. No.: 12/230,501

(22) Filed: Aug. 29, 2008

(65) Prior Publication Data

US 2009/0171499 A1 Jul. 2, 2009

(30) Foreign Application Priority Data

Aug. 30, 2007 (CA) ..... 2599775

(51) Int. Cl.
*B65H 5/22* (2006.01)
*B65H 85/00* (2006.01)

(52) U.S. Cl. ..... 271/3.01; 271/3.03; 271/3.14

(58) Field of Classification Search ..... 271/3.01, 271/3.03, 3.14; 414/789.9, 790.2, 790.3; 902/13, 15, 17

See application file for complete search history.

(56) References Cited

U.S. PATENT DOCUMENTS

| | | | | |
|---|---|---|---|---|
| 4,320,854 | A * | 3/1982 | Hirose | 221/12 |
| 4,618,302 | A * | 10/1986 | Kokubo et al. | 414/789.9 |
| 4,722,519 | A | 2/1988 | Zouzuolas | |
| 4,728,090 | A * | 3/1988 | Oota et al. | 271/7 |
| 4,765,607 | A | 8/1988 | Zouzuolas | |
| 5,240,368 | A * | 8/1993 | Graef et al. | 414/788.9 |
| 5,564,691 | A | 10/1996 | Hatamachi | |
| 5,927,936 | A * | 7/1999 | Arikawa et al. | 414/788 |
| 6,371,473 | B1 * | 4/2002 | Saltsov et al. | 271/3.01 |
| 6,889,850 | B2 * | 5/2005 | Amari et al. | 209/534 |
| 2008/0284085 | A1 * | 11/2008 | Curina et al. | 271/3.15 |

FOREIGN PATENT DOCUMENTS

| | | |
|---|---|---|
| EP | 0983952 | 3/2000 |
| GB | 704881 | 3/1951 |

* cited by examiner

*Primary Examiner* — David H Bollinger

(57) ABSTRACT

The invention relates to an apparatus for accumulating and dispensing bank notes of various length, width and condition without appreciable deformation of current note and displacement of previously stacked notes, preferably having a device connected in series to verify genuineness of bank notes inserted. Apparatus comprises a lockable removable box with a note transfer, stacker and dispensing mechanism. A note transfer mechanism comprises a belt drive with at least one spring claw for gripping note leading edge. Stacker mechanism comprises two reversible frames with longitudinal revolving panels on their side segments. Dispensing mechanism comprises spring loaded roll pallet with outlet gate. A note is pulled into apparatus by means of gripper under the belt translation. The notes stack or bundle is formed due to reversible motion of frames with corresponding side panels revolving. At the dispenser embodiment the bundle of notes slides out due to cooperative motion of driving belt and roll pallet. Belt and frames drivers are operated by microcontroller. Proposed apparatus is characterized by a simple and therefore economical compact flat construction, multi-purposing using, low energy consumption and high rapidity of action.

26 Claims, 9 Drawing Sheets

ENERGY-EFFICIENT COMPACT DEVICE FOR DISPENSING AND ACCUMULATING BANKNOTES

FIELD OF THE INVENTION

The invention relates to compact apparatus for accumulating and dispensing of bank notes of various length, width and condition without appreciable deformation of current note and displacement of previously stacked notes, preferably having a device connected in series to verify genuineness of bank notes inserted.

BACKGROUND OF THE INVENTION

Bank notes handling devices are well known and ubiquitous in everyday life. These devices are most often seen in automatic teller machines that can take in paper banknotes and return change, vending and gaming machines that take paper banknotes of various denominations, kinds and sizes. These devices are not only capable of accepting bank notes but also currency keeping, returning or payout (dispensing) of sum required.

Most of handy bank notes dispensing devices comprising primary internal accumulation of note bundle (a little stack of notes) with subsequent its conveyance to customer. So the note stacking mechanism is a common device for note dispensing and note storage apparatus.

Various devices are known for forming stacks of notes. For a long time it is known (U.S. Pat. Nos. 4,052,053; 4,420,153; 4,660,822; 4,728,096; 4,877,230; 4,936,564; 5,163,672; 5,267,826; 5,597,996; 5,975,273; 6,123,327; 6,196,464; 6,276,678; 6,422,458; 6,540,090; 6,824,046) and is widely used in note processing and calculating machines fast-acting rotary stacker. It comprises revolving stacker drum or wheel which has around its cylindrical surface several blades secured at their inner root parts to the drum and extending tangentially in the direction opposite to the drum rotational direction to their outer ends. Notes fed to and entering respective spaces between the blades to be accumulated into a neat stack. Variety of such devices is cash dispensing apparatus (U.S. Pat. No. 6,966,485) with single-gap stacker drum. A cash dispensing unit commonly includes several cooperating endless groups of belts for feeding a stack of bank notes to an exit location. Sometimes a cash dispensing unit is a simple open-sided or open-top cash container. However this drum is large (its diameter is approximate note width) and stacks good-quality notes along their transverse direction. Therefore it is impossible to use such device to stack notes (especially "street bills") along their longitudinal direction into compact box accumulating and dispensing devices.

The most commonly used stacking box devices (U.S. Pat. Nos. 4,512,263; 4,540,081; 4,678,072; 4,809,966; 4,834,230; 4,858,744; 4,880,096; 5,195,739; 5,209,395; 5,254,841; 5,286,017; 5,322,275; 5,372,361; 5,388,817; 5,419,423; 5,421,443; 5,641,157; 5,662,202; 5,836,435; 6,244,589; 6,585,260; 6,712,352; 6,827,347) are based on transposition method and comprise various pusher plate, pistol, arms, rollers and so on with which a note may be pushed from the plane along which the note is transported to the stacking mechanism (transport plane), into a cashbox situated adjacent to the banknote plane. The pusher transposes the note into the cashbox against the action of a restoring spring and convex notes stack surface. The notes are retained in a stack in the cashbox, when the pusher is withdrawn, by flanges which abut the sides of the uppermost surface of the banknote stack.

Although this type of arrangement provides an efficient method of stacking notes, the required depth of stroke of the pusher is linked to the note width and size of the aperture through which the banknote is pushed. Thus, a short depth of stroke is only possible if the aperture is slightly smaller than note width. The cashbox aperture must be substantially smaller than narrowest note this courses the increasing of pusher depth of stroke. An increased depth of stroke results in an increased cashbox depth for any given size of notes stack and an increased power consumption because of raising of performed work $P=F\times s$ (F—averaged force, s—pusher travel). Such devices are relatively slow because of retarded forward trace under which pusher bends the note and shifts the big mass of stacked notes. In order that the flanges should retain the stack of notes, it may be important that the notes are presented for stacking in a predetermined orientation and position. As cashboxes used with such devices often incorporate a restoring spring mounted under notes stack against which a pusher must work, a further problem may arise in such devices. Namely, despite successfully pushing the note into the cashbox, the note may not completely flatten against the stack and may become crumpled causing an interference with next inserted note.

In order to decrease stroke depth and displacement of notes stack certain devices apply a movable flanges in combination with a movable pusher which each move toward the other for pushing of a note received in the guide and adding this note to a stack (U.S. Pat. No. 6,241,240) or a stationary central support (punch) and movable flanges having slots therein adapted for receiving the note inserted thereto (U.S. Pat. No. 6,698,751). The outer support surface is provided with a durable frictional material along lateral edges thereof to prevent the note from sliding or otherwise moving upon the said surface under note banding. Said devices causes strong note banding during stacking process, are relatively slow in operation and have complicated shock unstable constriction. Additionally, it is complicated to thrust "street bill" into narrow long lateral channels in the movable flanges.

U.S. Pat. No. 5,624,017 discloses a compact low power cassette stacker with moveable stacker bars to stacking of bills rather than fixed flanges and a pusher plate thereby achieving an appreciable saving of space and permitting greater stacking capacity for notes. However this device is complicated and can't stacks notes with various width. Additionally, convex surface of notes received in a stacker projects into a bank-note transfer passage interfering with the next processing bill.

U.S. Pat. No. 5,564,691 describes stacking device comprising in a main validator body a pair of bill guide drums rotatably provided along both sides of a down-stream portion of the bill transport passage, each bill guide drum has groove along the axial direction thereof for inserting thereinto side edges of the inserted bill transported though the bill transport passage so that rotation of the pair of bill guide drums in opposite directions moves the inserted bill toward the removable cashbox. Each bill guide drum further has respective inner notches to engage a bill pushing plate provided in a space between the pair of said drums to push the inserted bill toward the received note stack during one drums turn. This device has complicated drums with variable cross-section along note length and belt transport system and can't stocks notes with various width and position across passageway. As stated above, convex surface of notes received in a stacker projects into a bank-note transfer passage interfering with the next processing bill. Additionally, it is hard to separate and to lock the removable cashbox from main validator body. A lot of devices operated similarly above mentioned are described in U.S. Pat. Nos. 5,639,081; 5,887,695; 6,217,021; 6,394,444; 6,543,763; 6,609,661; 6,641,047; 6,708,889. This devices try to avoid said disadvantages by incorporation various pressing levers, arms, rollers, shutters etc. In spite of significant device complication it is impossible as before to stock notes with various width and position across passageway. Furthermore the pressing stage decelerates the device operation and increases power consumption.

U.S. Pat. No. 6,607,189 describes stacking device wherein reception, storage and extraction of the documents are controlled by coordinated motions between a drive roller, a diverter, and special flaps. Said device is complicated, requires a bending of document stack and specified note surface frictional force. It is impossible to use said device for stacking "street bills' and notes with various length into compact box accumulating and dispensing devices.

Some dispensing devices (U.S. Pat. Nos. 6,032,948; 6,196,457; 6,241,150; 5,247,693; 6,484,938) employing high speed note bundle formation in free space chamber using note motion inertia, additional raping wheels or belts. Said devices commonly includes cooperating endless groups of belts for feeding a stack of bank notes to an exit location. Dispensers of this type are relatively large and can't operates with "street bill" because of its jamming and banding.

It is known (U.S. Pat. Nos. 4,337,864; 4,822,018; 5,735,516) notes bundle accumulating and dispensing devices of rotary or drum type. The notes bundle is accumulated and stored between outer cylindrical surface of rotating drum and driving belts system. The drum is rotated from certain initial position in one direction for storing notes as a bundle, and in a reverse direction of discharging the bundle. A special guide is biased towards the drum to lift sheets off the drum when the drum is rotated in the reverse direction. Said device is characterized by increased energy consumption at the start-stop operational mode, needs the exact speed and phase matching of inserted and accumulated notes, and is relatively slow and heavy.

With the foregoing in view, it is a primary object of the present invention to provide an energy efficient simple compact device for accumulating and dispensing bank notes of various condition, length, width and position in the passageway.

It is a general object of the present invention to decrease power consumption of stacking mechanism.

It is another object of the present invention to enhance durability of note handling units.

It is still another object of the present invention to minimize note banding during stacking process.

It is a yet another object of the present invention to provide a note stacking device which can prevent a note stored in the stacker from sticking out into the note intake passageway and interfering in the processing of the note to be transported next as much as possible.

It is a further object of the present invention to minimize note sticking to stacking mechanism.

The above and other objects and advantages of this invention will become more readily apparent when the following description is read in conjunction with the accompanying drawings.

SUMMARY OF THE INVENTION

The invention is based on the idea of inserting note of various lengths, widths and passageway positions into opened spring claw attached to driving belts with simultaneous fast start of belt drive means and gripping of note leading edge by said spring claw. Then gripped note is pulled into temporarily intake due to conveyance of said belts. Said temporarily intake under note inserting and conveyance is formed between driving belts on corresponding pulleys and flat longitudinal revolving panels on side segments of swivel frames. Said panels press the existing notes bundle to spring loaded pallet and so prevent said bundle from sticking out into the note intake passageway and interfering with the currently transported note. Finite phase of insertion procedure is note releasing from spring claw at the end of said intake with note simultaneous breaking by said claw and note stoppage on stop plate. Next stage of note handling is the fast transfer of inserted stopped note to existing bundle by fast pivoting motion on the opposite directions of swivel frames with simultaneous rotation of longitudinal revolving panels under the action of smoothly banded transferred note. The finite phase of note transfer is pressure of note bundle to spring loaded roll pallet by backward pivoting motion of said swivel frames with corresponding simultaneous rotation of longitudinal revolving panels. With this operation completed the temporarily note intake is formed again and device is ready to the next note insertion. Low inertia of belt drive means provides fast driving motor speeding-up and reliable capture of inserted note leading edge. Firm grip of said note end takes away the note frictional sliding across driving belts thus decreases influence of note condition and enhances durability of belt driver. Smooth banding of transferred note longitudinal sides and note bundle shifting motion about 5-6 mm results in low mechanical power dissipation during stacking phase. Slack pressure of banded note to longitudinal revolving panels and their fast relative motion under transferring phase minimizes note sticking to said panels. Pivoting motion on the opposite directions of swivel frames instead of traditional liner pusher shift allows decreasing stacker thickness about $\sqrt{2}$ times.

Issue of ready note bundle from dispenser is performed by cooperative motion of driving belt coupled with spring loaded roll pallet towards the dispenser outlet gate. Said coupling is performed by roll pallet salient tail arrester meshing with claw on inlet pulley under one-way fast pivoting motion on the opposite directions of swivel frames. After note bundle withdrawal said spring loaded roll pallet at said coupled state returned to initial position due to reversing motion of said driving belt.

Also provided, in accordance with preferred embodiment of present invention, is a method for note stacking including note insertion into note entering slit, fast start of belt drive means with simultaneous gripping of note leading edge by spring claw, note drawing into note temporarily intake, note releasing from spring claw at the end of said intake with note simultaneous breaking by said claw and note stoppage on stop plate, fast note transfer to existing notes bundle by fast pivoting motion on the opposite directions of swivel frames with simultaneous rotation of longitudinal revolving panels, pressing of note bundle to spring loaded roll pallet by reversible pivoting motion of swivel frames with corresponding simultaneous rotation of longitudinal revolving panels.

In dispenser embodiment method further comprises note bundle and spring loaded roll pallet pressure to belt drive means under one-way fast pivoting motion on the opposite directions of swivel frames with longitudinal revolving panels, fast start of belt drive means with simultaneous coupling of salient tail arrester of spring loaded roll pallet with belt claw, opening dispenser outlet gate, moving out of note bundle clumped between spring loaded roll pallet and belt drive means, backward moving of swivel frames with longitudinal revolving panels for pressure to spring loaded roll pallet and holding in dispenser the notes bundle rear part, return of belt drive means with spring loaded roll pallet to initial position after notes bundle withdrawal from dispenser.

In note accumulator embodiment method comprises note insertion into note entering slit, fast start of belt drive means with simultaneous gripping of note leading edge by spring claw, note drawing into note temporarily intake, note releasing from spring claw at the end of said intake with note simultaneous breaking by said claw and note stoppage on stop plate, fast note transfer to existing notes bundle by fast pivoting motion on the opposite directions of swivel frames with simultaneous rotation of longitudinal revolving panels, pressing of note bundle to spring loaded roll pallet by reversible pivoting motion of swivel frames with corresponding simultaneous rotation of longitudinal revolving panels, one-way fast pivoting motion on the opposite directions of swivel frames with longitudinal revolving panels for note stack pressure to belt drive means by spring loaded pallet. At that note storage in keeping position is performed without loading of movable stacking mechanism up to next note insertion to validator or notes withdrawing from cashbox.

Further provided is a method for note redirection comprises note insertion into note entering slit and note conveying to dispatcher or next accumulating device throw note directional switch wherein the commutation of said switch is performed by spring claw on belt drive means under its appropriate position at the driving pulley. Under subsequent note drawing edgewise to the temporarily intake chamber.

Still further provided is a method for driving means braking and exact positioning including note braking at the end of note intake by slow brake mode with recuperation of mechanical energy and stoppage of spring claw at the driving pulley by exact positioning mode.

Several embodiments of the present invention will now be described by way of example with reference to the accompanying drawings.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
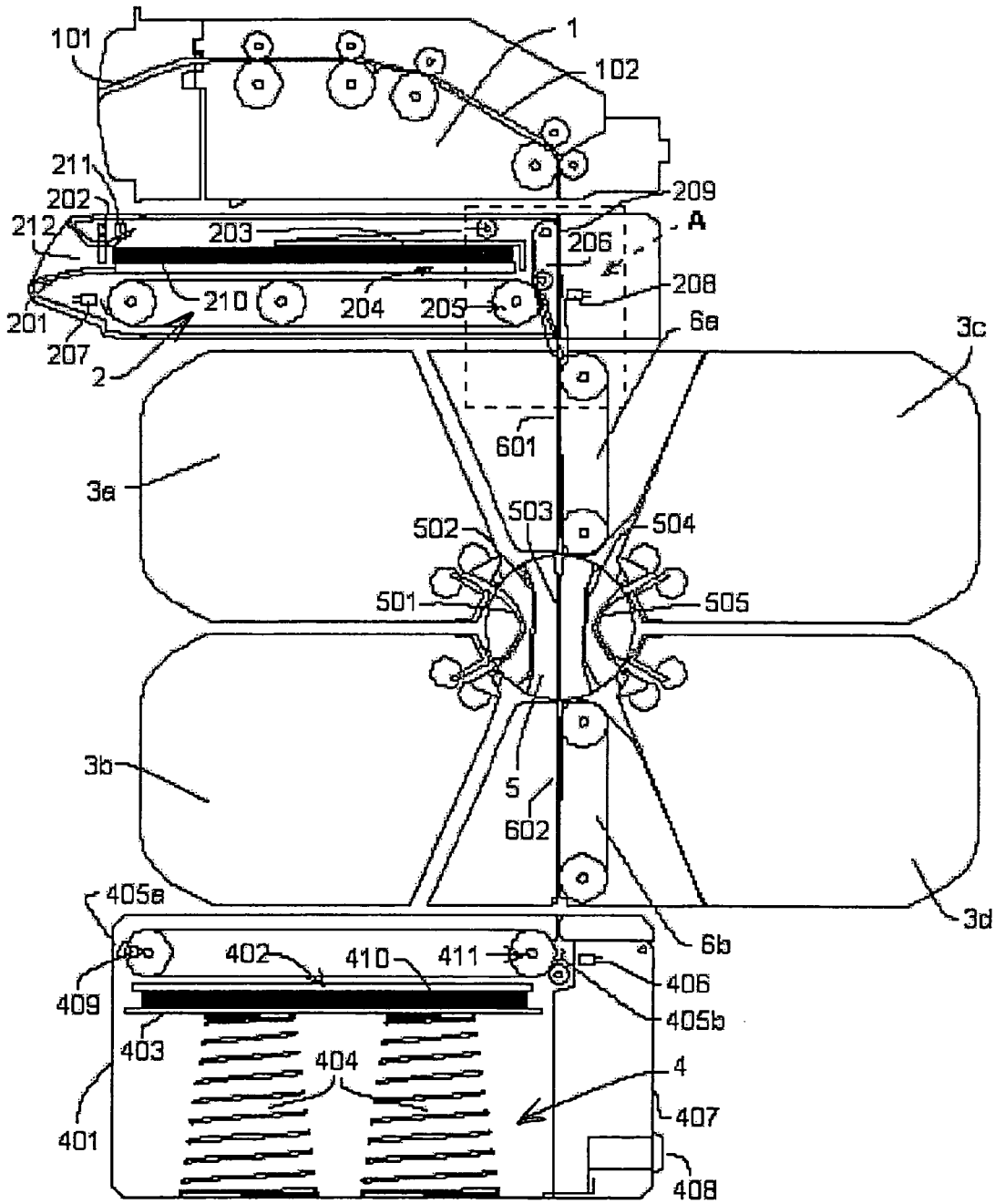
FIG. 1 is a schematic side view of a note handling apparatus for evaluating, storing and dispensing bank notes in accordance with the preferred embodiment of the present invention.

The note handling apparatus shown on FIG. 1 has a validator 1 for receiving of bank notes through the slot 101 and for processing the said notes along a pathway indicated as 102. If the banknote is acceptable, it leaves the validator 1 and is fed into the intermediate pathway 209. This intermediate pathway 209 with a vertical pathway 601 transports a received bank note to the rotary note dispatcher 5. Said rotary note dispatcher 5 has five different pathways 501-505 for transferring of a bank note to necessary temporarily notes accumulator 3*a*-3*d* or notes storage stacker 4. The note from each accumulator 3*a*-3*d* is transferred to the note dispenser 2 by means of said pathway 601 under appropriated position of rotary note dispatcher 5. The rotary note dispatcher 5 also performs a transportation function for moving bank notes between the accumulator devices 3*a*-3*d*.

The bank note removable storage stacker 4 is designed to receive bank notes which have been previously accumulated and forwarded to the stacker from one of the accumulators 3 along path 602. Thus, the drive paths 209, 501-505, 601, 602 are by-directional. A received just now bank note can also be directly processed to the removable banknote storage stacker 4. In this case the banknote is not returnable to the pathway and is removed from the apparatus when the storage stacker is removed.

The note dispenser 2 in accordance with the preferred embodiment of the present invention comprises plastic case 201 with outlet port 212 locked by gate member 202, note stacking means 204, note transfer means 205, note directional switch 206, input sensor 206, stop sensor 207 and note withdraw sensor 211. Said gate valve 212 is in cooperative coupling with spring loaded roll pallet 203 in order to open said gate under note bundle 210 moving out. Structure of note stacking means 204, note transfer means 205 and note directional switch 206 will be described in details below.

The removable note storage stacker 4 comprises lockable metal-plastic case 401 with door 407 and lock 408, note stacking means 402, note pallet 403 with restoring springs 404, note transfer means 411 with two spring claw 405*a* and 405*b* at the opposite sides of driving belt, input sensor 406 and stop sensor 409. Construction and operation of note transfer and note stacking means at note dispenser 2 and note stacker 4 is a similar. The said storage stacker 4 is removable from the apparatus and a replaceable bank note stacker is easily inserted or said stacker can be emptied and reinstalled.

The temporarily bank note accumulators 3*a*-3*d* are of an identical design and are replaceable, one with the other. Said accumulators form an opposed pair appropriately positioned on opposite sides of the pathway 601 and pathway 602. Banknotes forwarded from the validator 1 move downwardly through passageways 209, 601 and the validator 1 provides information with respect to the denomination of the particular bank note received and accepted. Bank note accumulator 3*a* may accumulate $5.00 bank notes, accumulator 3*b* may accumulate $1.00 bank notes, accumulator 3*c* may accumulate $10.00 bank notes and accumulator 3*d* may accumulate $20.00 bank notes as one example. The apparatus can be programmed to change the denomination of the bank notes stored. In the case of gaming machines it may be desirable for one accumulator to store large denomination bills which can be dispensed if there is a large payout. It is also possible to use one of the bank note accumulators, such as accumulator 3*a* as an escrow accumulator. For example, a user might enter several bank notes into the validator for a particular transaction and these bank notes are fed from the validator to the escrow accumulator 3*a*. The apparatus keeps track of the number of bank notes fed to the accumulator and the value thereof. If the transaction is terminated, either due to insufficient funds or based on instructions from the user, the same bank notes received from the user and stored in the escrow accumulator 3*a* are sequentially returned to path 601 and transported upward to the dispenser 2 throw diverted note directional switch 209. The dispenser 2 receives the bank notes from the escrow accumulator, stacks them one atop of the other and dispenses the note bundle through port 212. In this way, the identical bank notes are returned to the user.

Figure 2:
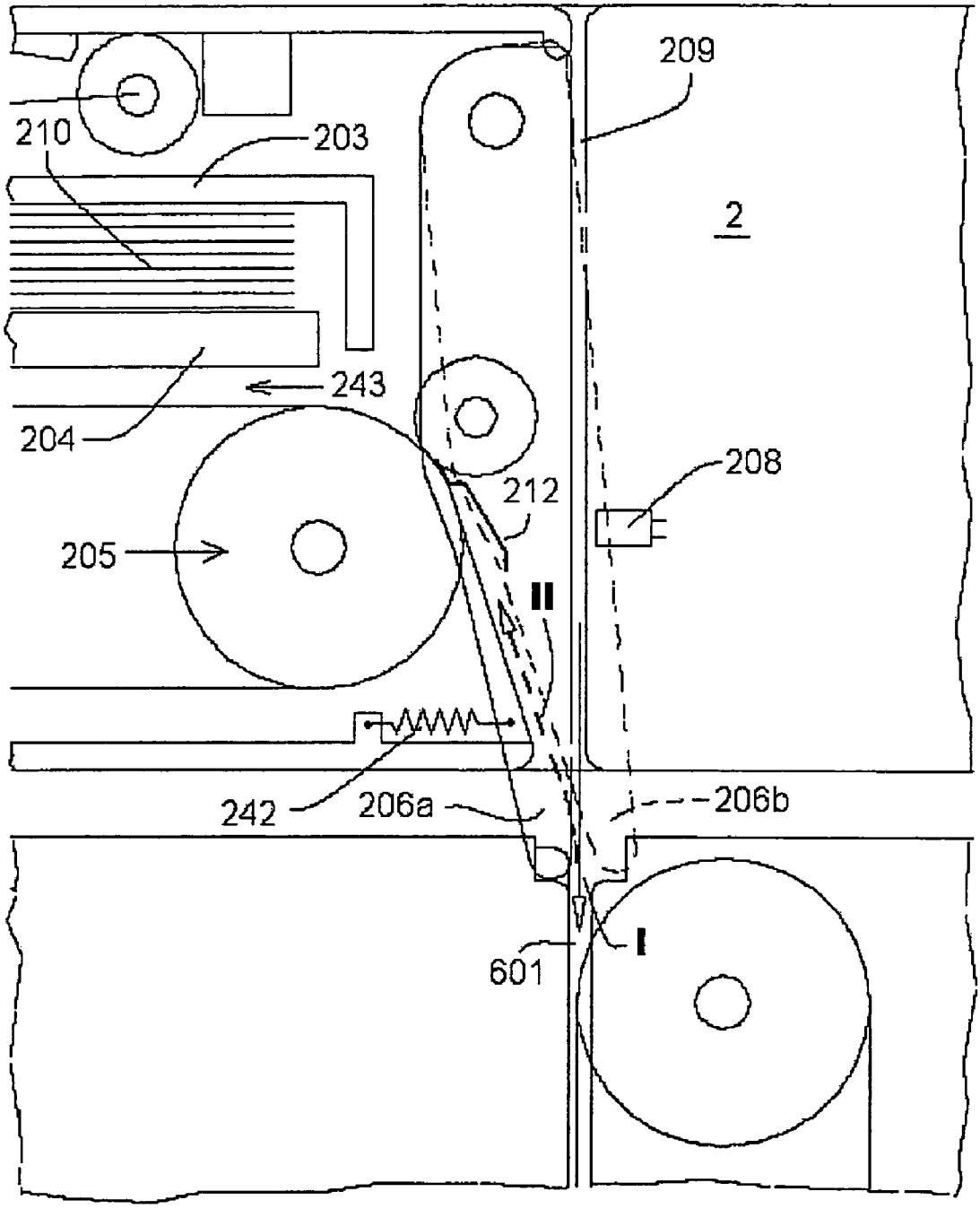
FIG. 2 is an enlarged schematic cross-sectional side view of note directional switch region A specified on FIG. 1 by dotted line.

Bank note directional switch (dotted insert A on FIG. 1) is shown in details on FIG. 2. At the bank note redirection position directional switch 206*a* (solid line) forms a transient passageway 209 (solid line I) for note pass-through to the note passageway 601. Said position is organizes due to pulling spring 242 under the absence of spring claw 212 at the driving pulley of belt driving means 209. At the note gripping position under pressure of spring claw 212 (as shown on FIG. 2) directional switch stands at the position 206*b* (dotted line) so forms the bank note entering channel (dotted line II). Under subsequent note drawing edgewise from said entering channel to the temporarily intake chamber 243 the gripping position 206*b* is maintained due to note presence in the said entering channel II. So the note transfer from note dispatcher into temporarily intake chamber and note pass-through is performed transversely.

Figure 3:
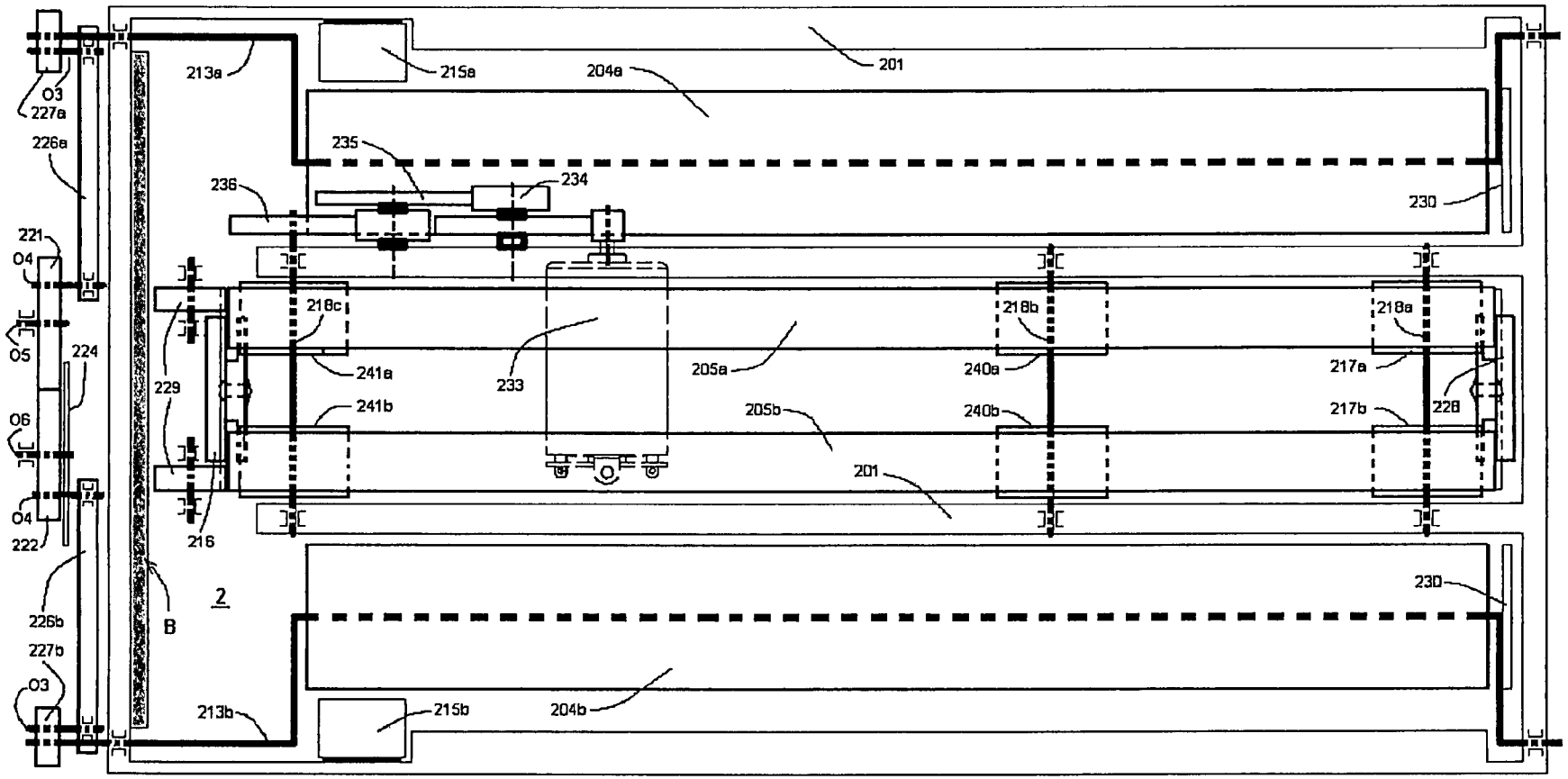
FIG. 3 is a schematic plan view of the note transfer and stacking mechanism in accordance with the preferred embodiment of the present invention.

Schematic plan view of the note transfer and stacking mechanism of dispensing unit 2 in accordance with the preferred embodiment of the present invention is shown on FIG. 3. It comprises case 201, two toothed belts 205*a* and 205*b*, two driving pulleys 241*a* and 241*b* on the axis 218*c*, end pulleys 217*a* and 217*b* on the axis 218*a*, intermediate pulleys 240*a* and 240*b* on the axis 218*b*, two spring claw 216 and 228 at the opposite ends of driving belts 205*a*, 205*b* for gripping of note leading edge, two pressure rollers 229, two ⊔-shaped frames 213*a* and 213*b* with longitudinal revolving panels 204*a* and 204*b* on corresponding side segments of said frames, two flat return springs 215*a* and 215*b*, gear transmission 234-236 with DC reversible motor 233 for belt driving, crank-and-rod mechanism 221, 222, 226*a*, 226*b*, 227*a*, 227*b* for clockwise and anticlockwise rotation of swivel frames 213. The sector disk 224 for frames position sensing is also joined to driving gear 222. Hazy zone B indicates the bank notes pass-through area across dispensing unit 2. Each frame 213 has note stop wall 230.

Figure 4:
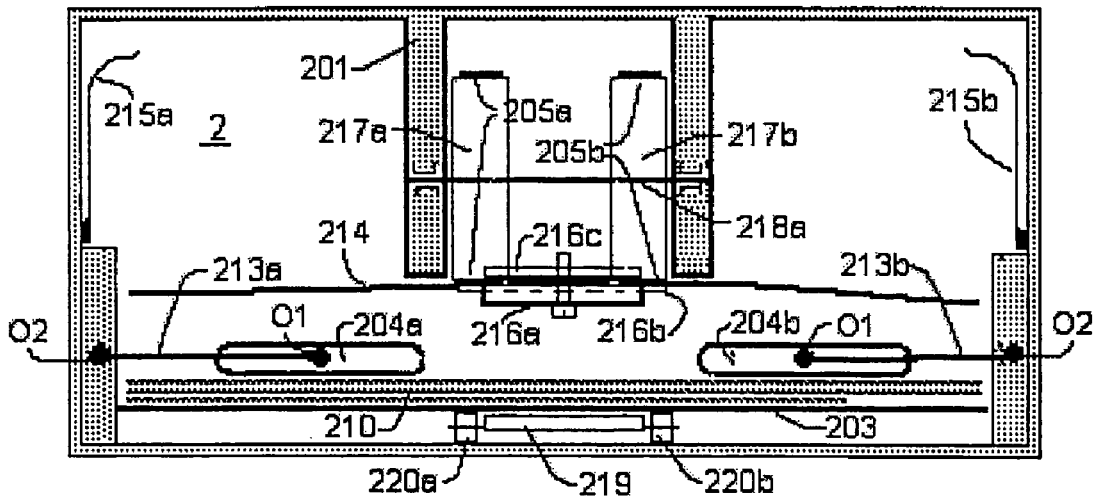
FIGS. 4 through 7 are simplified cross-sectional views of the moving and constructive parts for explaining the operation of the proposed note stacking mechanism.

FIGS. 4 through 7 are simplified cross-sectional views of the moving and constructive parts for explaining the operation of the note stacking mechanism with swivel frames and revolving longitudinal panels. FIG. 4 shows note 214 drawing into note temporarily intake formed between belt drive means 205*a,b* and longitudinal revolving panels 204*a,b* on side segment of swivel frames 213*a,b*. The drawing note 214 is griped between flat clutch 216*a* and driving belts 205*a,b*. Fixing part 216*c* fasten spring claw to toothed driving belts. Spacer 216*b* forms the wide nip during note insertion into spring claw in order to improve gripping of crumpled note. The longitudinal revolving panels 204*a,b* presses the existing note bundle 210 to spring loaded pallet 210 and squeezes the flat restoring spring 219. The note 214 is pulled up to the end of temporarily intake in gripping state by means of corresponding conveyance of driving belts.

Figure 5:
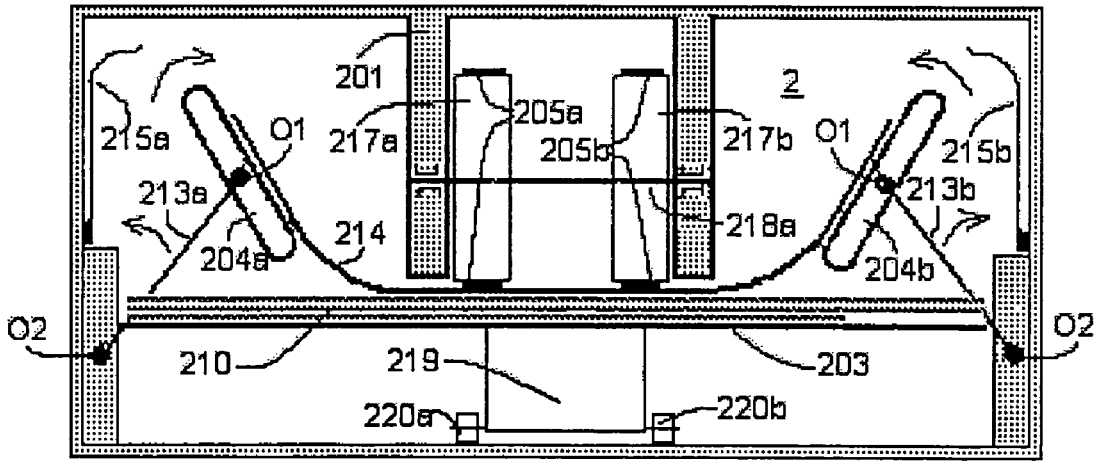

FIG. 5 shows the first phase of the note 214 transference to existing note bundle 210. Before said phase driving belts 205*a,b* and note 214 are stopped. Due to clockwise and anticlockwise rotation of frames 213*b* and 213*a* note bundle 210 and inserted note 214 are pressed to belts 205*a,b* and corresponding pulleys 217*a,b*, 240*a,b*, 241*a,b* by spring loaded pallet 203. Simultaneously longitudinal panels 204*a,b* under pressing of smoothly banded note 214 revolves at the opposite directions as shown on FIG. 5 with respective arrows.

Figure 6:
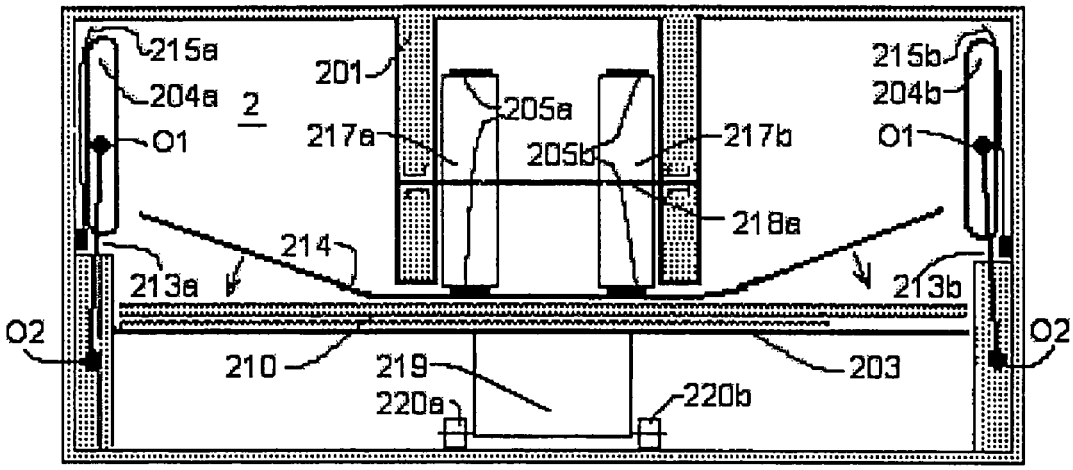

FIG. 6 shows the next phase of the note 214 transference to existing note bundle 210—longitudinal edges of note 214 slip from revolving panels 204*a,b* and under spring power of banded note sheet and compressed air cushion move towards existing bundle 210. The influence of compressed air cushion is effective only under fast note transference (note transfer time about 50÷150 msec). Swivel frames 213*a,b* and revolving panels 204*a,b* at the end of this phase are approximately perpendicular to note bundle plan so note bundle in dispenser or note stack in storage cashbox is pressed to belt drive means and stationary parts of case 201 by spring loaded pallet. Note storage in said keeping position is realized without loading of movable stacking mechanism up to next note insertion to validator or notes withdrawing from cashbox. The flat return springs 215*a* and 215*b* in this phase are strained and pressed to side walls of case 201 by the far ends of revolving panels 204*a,b*.

Figure 7:
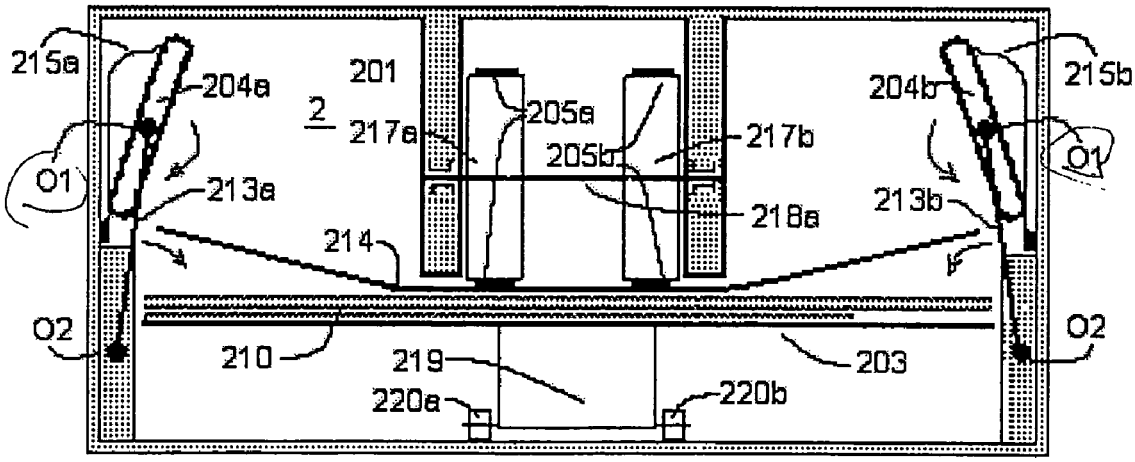

FIG. 7 shows the final phase of the note 214 transference to existing note bundle 210—pressing of last inserting note 214 to bundle 210 by longitudinal revolving panels 204*a,b* under return motion of swivel frames 213*a,b*. At the initial stage of this phase said panels 204*a,b* quickly revolve around their longitudinal central axes O1 (shown by arrows) under force from strained springs 215*a,b*. Said revolving ensures the effective transference of strongly crumpled note to existing note bundle. The final result of said phase is pressing of obtained note bundle 210 with spring loaded pallet 210 to the case 201 as shown in FIG. 4. Thereafter the described mechanism is ready to next note insertion.

Figure 8:
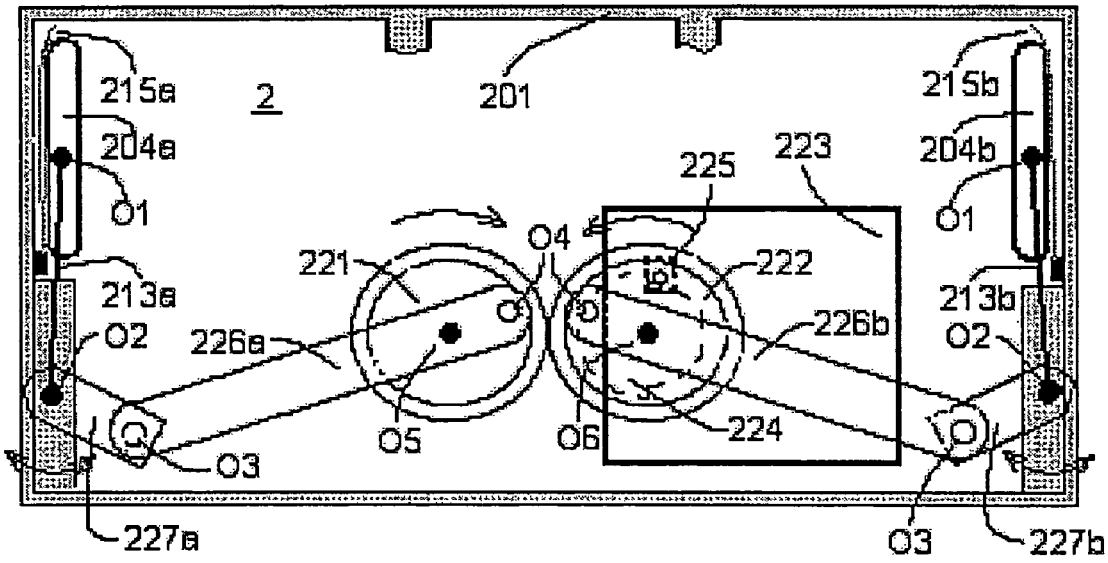
FIG. 8 is schematic end view of swivel frames driver for case of transmission with two contrarotating gear cranks.

The schematic end view of swivel frames driver for case of transmission with two contrarotating gear cranks 221, 222 is shown on FIG. 8. Gear crank 222 is rotated in one direction by DC driver 223. Said crank has sector disk 224 for operation of position sensor 225. The rods 226*a* and 226*b* are joined to corresponding lever arms 227*a* and 227*b* by axes O3 and to contrarotating gear cranks 221, 222 by pivot O4. Lever arms 227*a,b* are fixedly connected to the end segments of swivel frames 213*a,b* as shown in FIG. 3.

Figure 9:
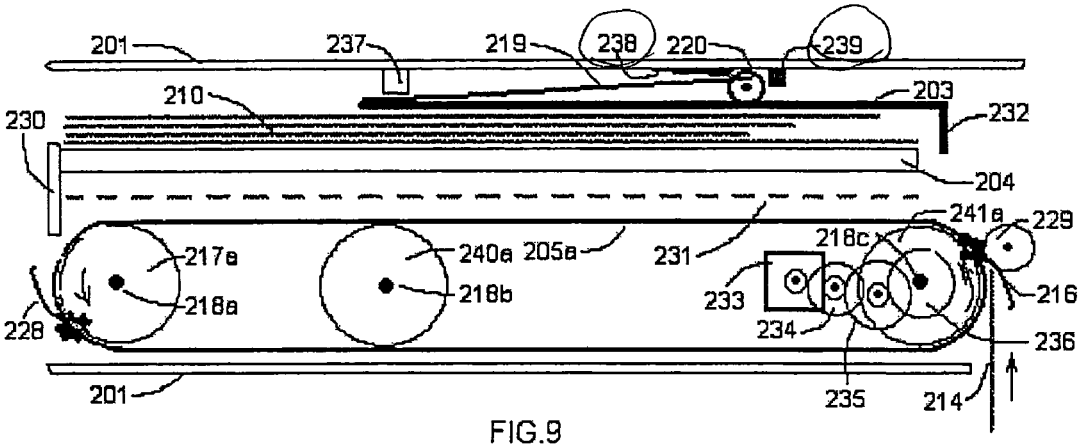
FIGS. 9 through 12 are simplified longitudinal section views of the moving and constructive parts for explaining the operation of the note pulling and dispensing mechanism in accordance with the preferred embodiment of the present invention.

FIGS. 9 through 12 are simplified longitudinal section views of the moving and constructive parts for explaining the operation of the note pulling and dispensing mechanism in accordance with the preferred embodiment of the present invention. FIG. 9 represents mechanism position under note 214 insertion into open spring claw 216. The result of note 214 insertion into said spring claw (shown on FIG. 1 sensor 208 is actuated) is fast start of belt drive means with simultaneous gripping of note leading edge by said claw. Then gripped note is pulled into temporarily intake shown on 9 by dotted line 231. Said note temporarily intake is formed between belt drive means and longitudinal revolving panels 204. The existing note bundle 210 and spring loaded pallet 203 at that is pressed to case 201 by panels 204 on corresponding swivel frames. When gripped note leading edge reached end pulley 217*a* the spring claw 216 opens, realizes and brakes said note. Note 214 knocks at stop wall 230 and halts. Than note 214 is transferred to existing bundle 210 with noted above procedure.

Figure 10:
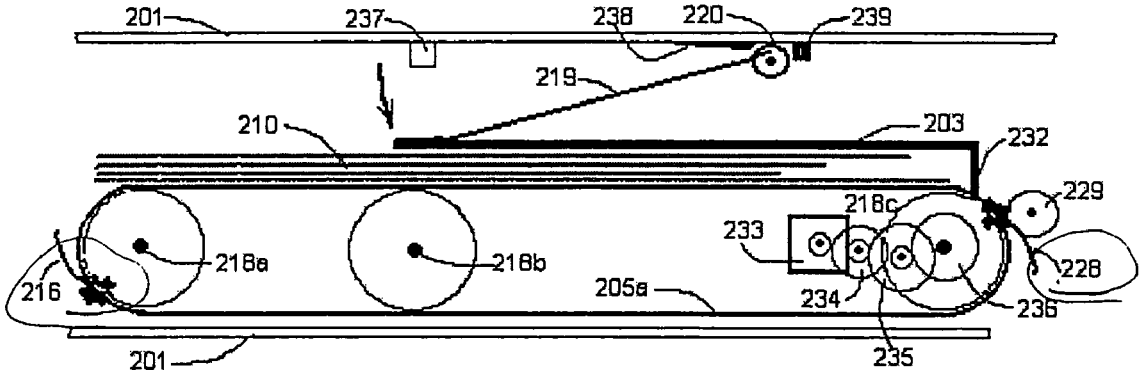

FIG. 10 shows the initial phase of the note bundle 210 dispensing. At that the swivel frames with revolving panels are in deflected position shown on FIG. 6. The note bundle 210 at that is pressed to belt driving means by spring loaded pallet 203. The initial longitudinal position of pallet 203 is fixed by stop member 239 and start-point support 238. The pallet salient tail arrester 232 is situated side by side with spring claw 228 and cooperates with said claw under note bundle dispensing action. Start-point support 238 stabilizes the initial longitudinal position of pallet 203 under outer mechanical shocks and swivel frames movement.

Figure 11:
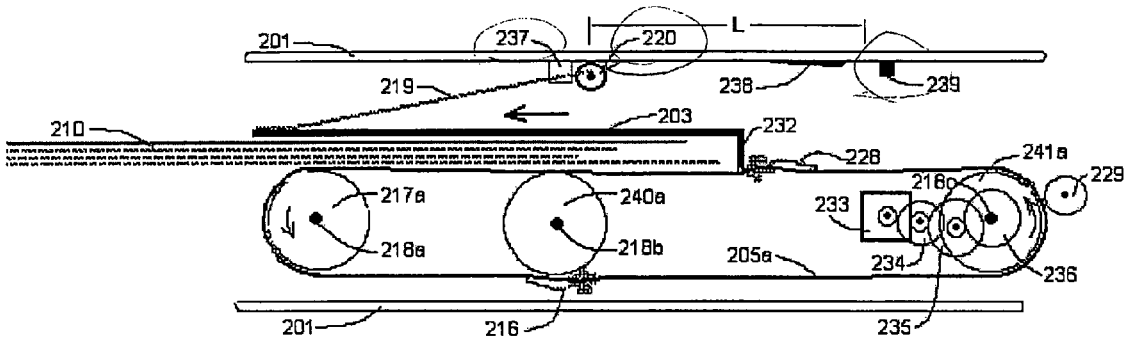

FIG. 11 shows next dispensing phase—pushing out the note bundle 210 clumped between driving belts 205 and spring loaded pallet 203. The spring claw 228 abuts on the pallet salient tail arrester 232 and under belt displacement in the line of arrow pushes out the said pallet together with note bundle on the distance L up to the stop of rollers 220 by travel limiter 237.

Figure 12:
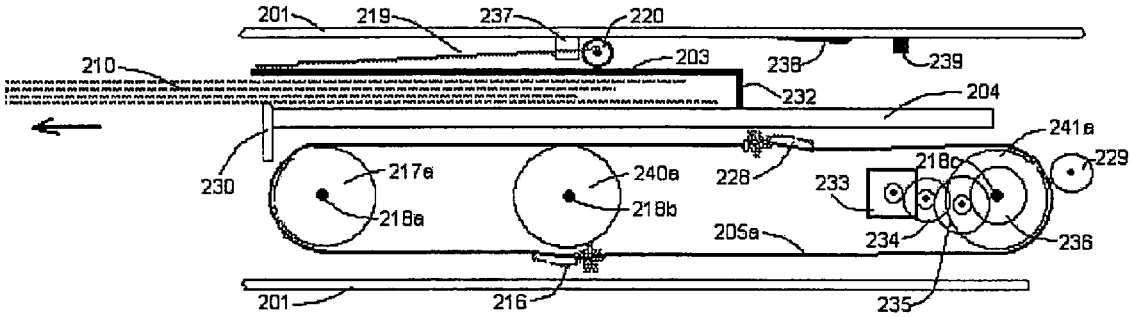

FIG. 12 shows the final dispensing phase—manual withdraw of note bundle 210. At first swivel frames with panels 204 quickly (about 50÷80 msec) presses note bundle 210 with pallet 203 to case 201 for stable keeping of said pushed out note bundle 210. Then note bundle 210 may be manually withdrawn from dispenser by customer at any moment. After said withdrawn (indicated by sensor 211 shown on FIG. 1) dispensing mechanism returns to initial position by backward motion of driving belts 205*a,b*.

Figure 13:
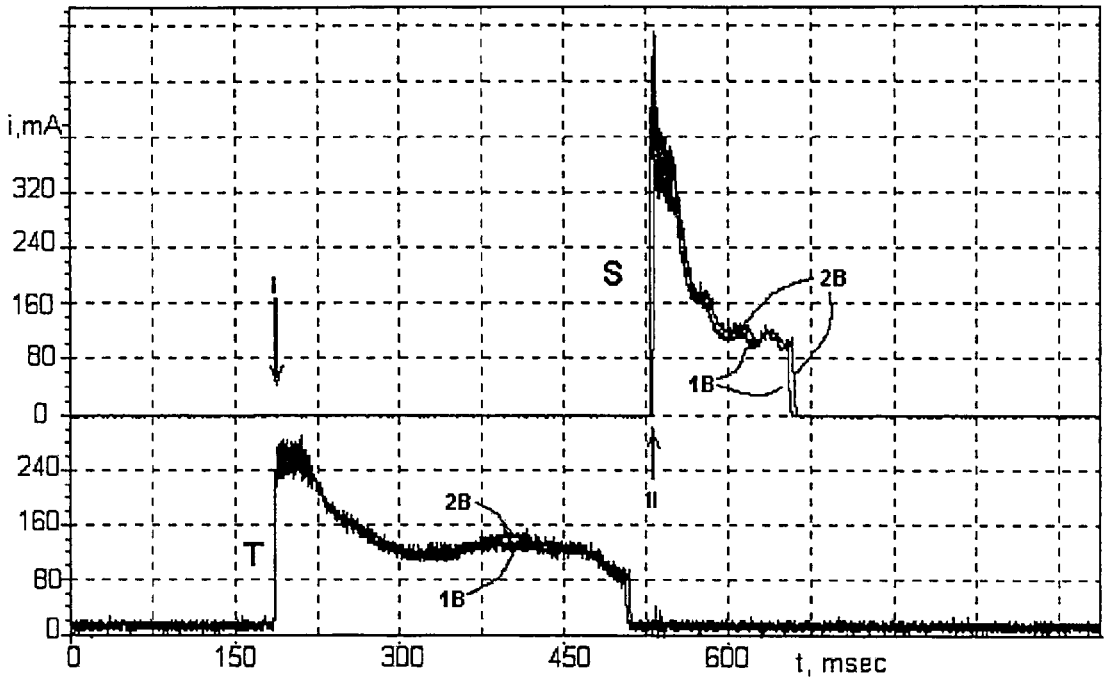
FIG. 13 shows a typical kinetics of apparatus power consumption under note stacking procedure.

FIG. 13 shows a typical kinetics of apparatus power consumption under note stacking procedure. Curve T describes the current consumption of driving belts motor, curve S—of swivel frames driving motors. Curves 1B corresponds for single bank note insertion, 2B—for double overlapped insertion. Doubled overlapped insertion results in only 10% energy consumption increasing. Arrows I and II indicate the start moments of belts and frames driving motors correspondingly.

Figure 14:
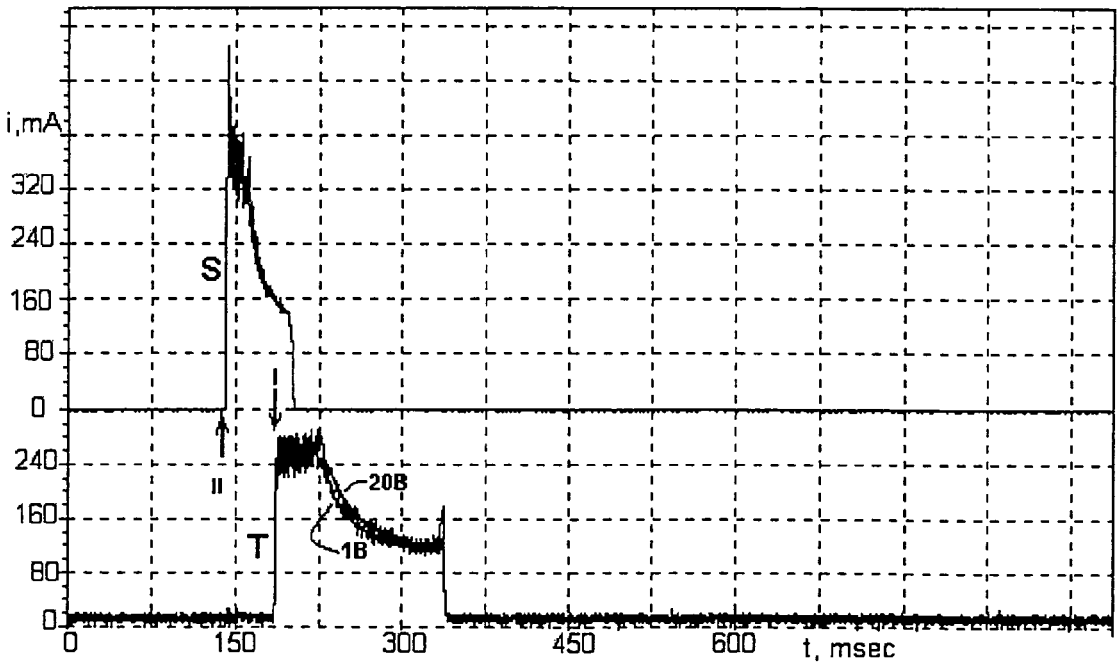
FIG. 14 shows a typical kinetics of apparatus power consumption under note bundle dispensing procedure.

FIG. 14 shows a typical kinetics of apparatus power consumption under note bundle dispensing procedure. Curve T describes the current consumption of driving belts motor, curve S—of swivel frames driving motors. Curves 1B corresponds for single bank note dispensing, 20B—for dispensing of 20 notes bundle. Dispensing of 20 notes bundle results in only 7% energy consumption increasing. Energy consumption of frames driving motor is independent of note number in the bundle because of swivel frames and longitudinal panels moving in the free space. Arrows I and II indicate the start moments of belts and frames driving motors correspondingly.

The present invention is described herein in the contexts of a fast effective bank note dispenser and accumulator as for a currency handling device or automatic cash machine, in a bank, postal facility, supermarket, casino or transportation facility. However, it is appreciated that the embodiments shown and described herein may also be useful for dispensing and accumulating other objects, particularly flat, such as sheets of paper, bills, films, plates and cards. The dispensing and accumulating device may be stationary or portable, battery powered or powered by connection to an electric outlet.

It is appreciated that various features of the invention, which are, for brevity, described in detail for dispenser embodiment, may also be provided separately or in any suitable combination.

It will be appreciated by persons skilled in the art that the present invention is not limited to what has been particularly shown and described above. Rather, the scope of the present invention is defined only by the mentioned claims.

Although various preferred embodiments of the present invention have been described herein in detail, it will be appreciated by those skilled in the art, that variations may be made thereto without departing from the scope of the appended claims.

The embodiments of the invention in which an exclusive property or privilege is claimed are defined as follows:

1. An apparatus for accumulating and dispensing of bank notes supplied thereto from validator means, said apparatus comprising:

a housing including an intake chamber and an accumulating chamber, an inlet port through which a bank note is supplied to the intake chamber and an outlet port through which bank notes are dispensed;

a note pulling means for engaging a lead edge of a banknote adjacent said inlet port and drawing the banknote into said intake chamber, said note pulling means comprises at least one belt drive means with at least one spring claw for engaging said lead edge of a bank note;

a stacking means for transferring a bank note from said intake chamber into said accumulating chamber, said stacking means comprising two reversible swivel frames with each swivel frame having a longitudinal revolving panel positioned along opposite sides of a banknote received in said intake chamber;

dispensing means in said accumulating chamber for dispensing banknotes accumulated in said accumulating chamber through said outlet port;

said dispensing means comprising a spring loaded roll pallet; and drive means for operating said belt drive and said reversible swivel frames.

2. An apparatus of claim 1 wherein said housing includes a note directional switch having a first position for directing bank notes into said intake chamber and a second position for directing a banknote to a different device.

3. An apparatus of claim 1 wherein said belt drive means is disposed centrally in said intake chamber and extends in a length thereof;

and wherein each belt drive means comprises an endless toothed belt with a driving pulley, a driven intermediate pulley and an end pulley.

4. An apparatus of claim 3 wherein each spring claw is attached to and cooperates with the toothed belt to form a closed claw at the belt adjacent the inlet port and downstream of the driving pulley and an open claw at the driving pulley and the end pulley.

5. An apparatus of claim 4 wherein each toothed belt includes two spring claws attached at opposite ends of the toothed belts.

6. An apparatus of claim 5 wherein said start and stop sensors are optocouplers selectively interrupted by said spring claws.

7. An apparatus of claim 3 wherein belt drive means further includes start and stop sensors used to start and stop said driving pulley.

8. An apparatus of claim 1 wherein each reversible swivel frame has ـ-shaped profile with ability of clockwise and counterclockwise rotation, said swivel frames in a pressing position pressing banknotes accumulated in said accumulating chamber and movable to an unload position for dispensing of accumulated banknotes.

9. An apparatus of claim 1 wherein said frames with revolving panels in the pressing position are approximately parallel to bank notes accumulated in said accumulating chamber.

10. An apparatus of claim 1 wherein said swivel frames with revolving panels in the unloaded position are approximately perpendicular to bank notes accumulated in said accumulating chamber.

11. An apparatus of claim 1 wherein a distance between rotation axes of said frames is approximately equal to the width of the longest width note to be accepted.

12. An apparatus of claim 1 wherein each longitudinal revolving panel is made from low friction plastic with rounded longitudinal edges.

13. An apparatus of claim 12 wherein each longitudinal revolving panel has a panel rotation axis that passes through its center of inertia.

14. An apparatus of claim 1 wherein the roll pallet includes a tail arrester that cooperates with said spring claw to drive said roll pallet during dispensing of banknotes.

15. An apparatus of claim 14 further including sensors for detection of banknotes on the roll pallet and the passage of banknotes through said outlet port.

16. An apparatus of claim 15 wherein said sensor is an optocoupler with an open optical channel interrupted by banknotes in said accumulating chamber.

17. An apparatus of claim 15 wherein said optocouplers have fiber-optic cables defining an optical sensing gap.

18. An apparatus of claim 1 wherein said belt drive means includes a reversible DC motor with a reduction gearbox.

19. An apparatus of claim 1 wherein said drive means of said swivel frames include two counter rotating gear cranks.

20. An apparatus of claim 1 wherein said drive means of said swivel frames include two counter rotating pivoted link rocker arms.

21. An apparatus of claim 1 wherein said drive means of said swivel frames includes two gears with an associated drive rack bar.

22. An apparatus of claim 1 wherein said drive means of said swivel frame includes a DC motor with a gearbox and a frame position detector.

23. An apparatus of claim 1 wherein said drive means for said belt drive and said drive means for said swivel frames comprises a single reversible DC motor and two clutches with clockwise and anticlockwise rotation and a frame position detector.

24. An apparatus of claim 23 wherein said frame position detector is an optocoupler with an open optical channel interrupted by a shutter driven by said gearbox.

25. An apparatus of claim 1 wherein said bank note intake chamber is formed between said belt drive means and said longitudinal revolving panels of said swivel frames.

26. An apparatus of claim 1 wherein said drive means for operating said belt drive and said drive means for said two reversible frames comprise a single DC motor and a selective drive arrangement.

* * * * *